United States Patent [19]

Toeppen

[11] 4,241,842

[45] Dec. 30, 1980

[54] TAMPER INDICATING CONSTRUCTION FOR PLASTIC CLOSURES

[76] Inventor: Thurston H. Toeppen, Lois La., R.D. 3, Poughkeepsie, N.Y. 12603

[21] Appl. No.: 64,105

[22] Filed: Aug. 6, 1979

[51] Int. Cl.[3] ..... B65D 41/34

[52] U.S. Cl. ..... 215/252

[58] Field of Search ..... 215/252, 253

[56] References Cited

U.S. PATENT DOCUMENTS

| | | | |
|---|---|---|---|
| 2,116,938 | 5/1938 | White | 215/252 |
| 3,231,123 | 1/1966 | Heierle | 215/253 X |
| 3,484,012 | 12/1969 | White | 215/25 2 |
| 3,675,805 | 7/1972 | Shane | 215/253 |
| 4,126,240 | 11/1978 | Brach | 215/252 |
| 4,153,174 | 5/1979 | Keeler | 215/252 |
| 4,156,490 | 5/1979 | Peraboni | 215/252 |

FOREIGN PATENT DOCUMENTS

| | | | |
|---|---|---|---|
| 628172 | 11/1961 | Italy | 215/252 |
| 1209395 | 10/1970 | United Kingdom | 215/252 |

*Primary Examiner*—Donald F. Norton

[57] ABSTRACT

A resilient plastic screw-type closure, for use with any of a number of standard container top designs, is molded with a plurality of indicating members comprising a detachable lower rim of the closure. As initially molded, the indicating members are outside the principal external contours of the closure, but after installation on the container they are tilted inward until retained by locking means within the principal contours. In this condition they are positioned underneath an annular shoulder formed around the neck of the container. Thereafter, the closure cannot be removed, or substantially loosened, without partially or wholly detaching the indicating members from the body of the closure.

12 Claims, 12 Drawing Figures

SEC. A-A

SEC. B-B

TAMPER INDICATING CONSTRUCTION FOR PLASTIC CLOSURES

BACKGROUND OF THE INVENTION

In the container industry it is frequently desirable to provide some means for indicating whether or not a container, of the type having a reusable closure, has been opened after once being sealed, in order to know whether the contents may have been tampered with.

Many constructions have been devised for this purpose, however, they are not fully satisfactory and suffer draw-backs. For example, a well known metal beverage cap incorporates a detachable rim which is torn off and remains on the container neck when the cap is removed for the first time. This approach gives a clear indication of tampering, but the sharp edges on the removed cap, and the presence of the loose ring on the container neck, are objectionable. Some other approaches have incorporated tear strips which always require an extra operation on the part of the user; these usually require reading of instructions by the user, may have projecting elements which are liable to catch on clothing and other external objects, and may result in littering the ground in public places. Another group of tamper-indicating closure designs depends upon bulky or unusual container-neck-constructions, which must be used with the particular closure.

SUMMARY OF THE INVENTION

The construction described herein provides for a closure having a compact and attractive appearance which is sanitary in use and provides clear and reliable evidence of tampering. It may be used with any of a number of industry-standard container top designs. It advantageously does not leave any unwanted residue on the container neck or any loose pieces, and does not require any special knowledge, reading of instructions, or extra operations on the part of the user. Further, it has no sharp projecting elements. It is easily molded and requires only a relatively simple modification of standard capping equipment for installation, without sacrifice of capping speeds. Alternatively, the invention may be used to close any form of container outlet where a tamper-indicating feature may be desired.

The invention comprises a series of semi-independent indicating members distributed around the lower rim of an otherwise-conventional screw-type closure made of a resilient plastic such as polyethylene or polypropylene, for use on glass, plastic, or metal containers. These rim members are connected to each other and to the body of the closure by a number of small, integrally-molded bridges, the strength of which may vary according to the pattern of tamper-indication desired. Each of the rim members has the basic form of a tetrahedron, though considerably modified in detail. This serves as an actuating element to initiate breakage of certain of the bridges during unscrewing of the closure. In a preferred embodiment shown herein, there are eight indicating members along the rim, but more or less may be used.

As initially molded, each of the indicating members is positioned outside of the principal external contour of the closure and is connected to the body of the closure by three of the small bridges, each at one point of the basic tetrahedron, a fourth point projects away from the body of the closure. After the closure has been screwed on to the container, each of the tetrahedrons is pressed inward, causing it to move underneath an annular shoulder which is a feature of the container neck. At the same time, an integral locking means operates automatically to hold it in the inward position. Subsequently, when the closure is unscrewed, the annular shoulder restrains the tetrahedral elements in their new positions and thereby causes breakage of the weaker bridges, according to the preferred pattern of tamper indication.

DESCRIPTION OF THE PREFERRED EMBODIMENTS

Figure 1:
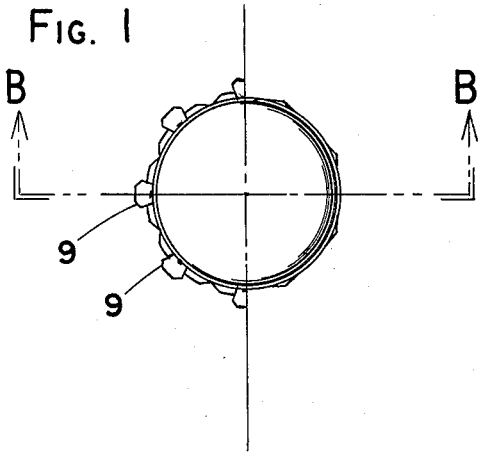
FIG. 1 is a top view of the preferred embodiments of the invention, in which the portion to the left of the centerline shows the condition of the indicating members as molded, before installation, while the portion to the right of the centerline shows the condition after they have been tilted into their locked positions.
Figure 2:
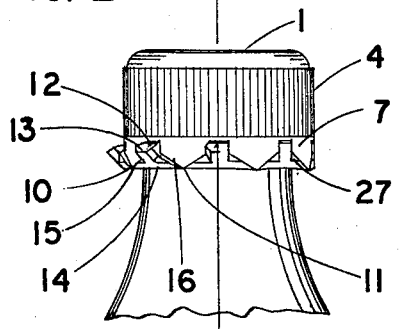
FIG. 2 is a side view corresponding to FIG. 1.

As shown in FIGS. 1 and 2, the invention is embodied in a plastic screw-type closure molded of polyethylene, polypropylene or a similar resilient plastic. The left half of each figures shows it in the as-molded condition, screwed on to the container; the right half shows it after completion of the installation.

Figure 4:
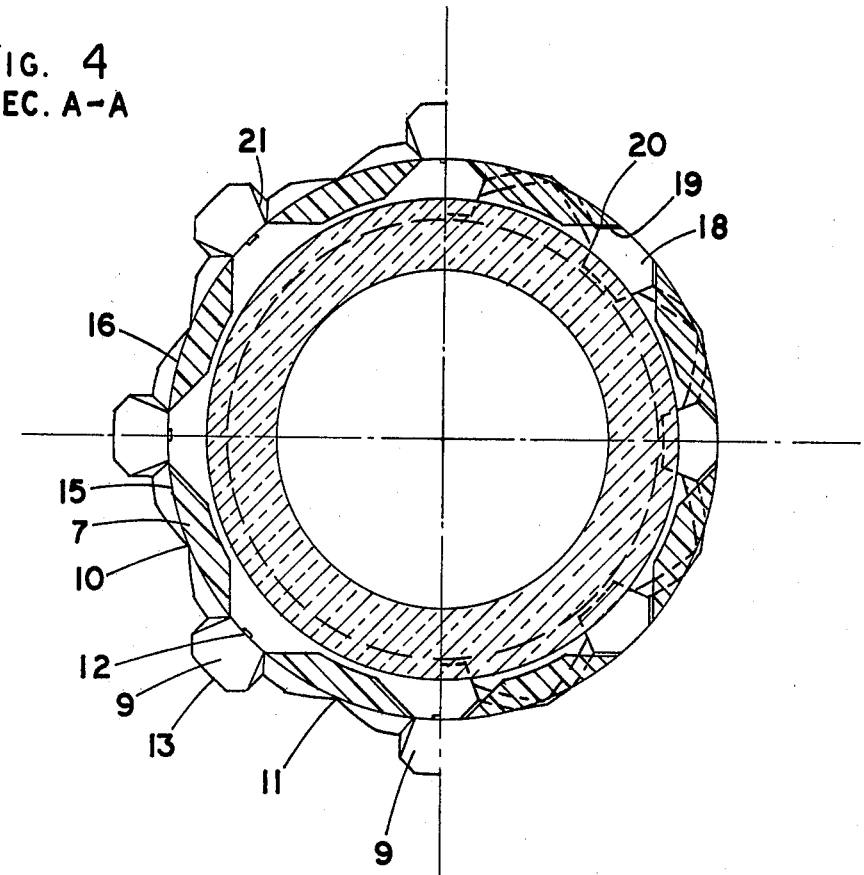
FIG. 4 is an enlarged sectional view of the indicating members and body of the closure, together with the container, as viewed from the top at plane A—A of FIG. 3. Again, the left side of the figure shows the positions of the indicating members before installation, while the right side shows them after installation.
Figure 5:
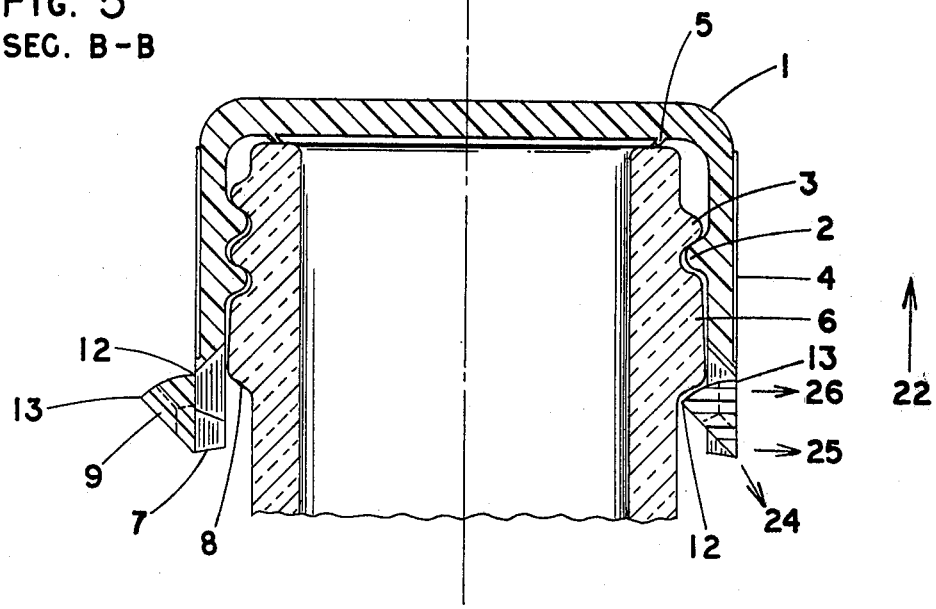
FIG. 5 is a side sectional view corresponding to FIG. 4 as seen at plane B—B of FIG. 1.

As shown in the enlarged section in FIGS. 4 and 5, the body or shell 1 incorporates an internal screw thread 2 to mate with a corresponding container thread 3, and external knurls or flutes 4 by which it may be gripped to rotate it on to or off of the container. One or more sealing lips may be provided as at 5 to mate with smooth surfaces on the top portion of the container to seal the contents against fluid or gas leakage.

Another standard feature of many such container tops is a annular neck ring 6, a raised band which serves to strengthen the neck and help prevent damage to the threads. The neck ring is also often used as a buttress to actuate tamper-indicating features, as in the present instance. To this end, parts of the lower portion of skirt 7 of the closure project below the lower shoulder 8 of the neck ring. As shown in FIGS. 1 and 2, these projections support a plurality of detachable, or partly detachable, indicating members 9 which form a more or less continuous chain around the rim.

As clearly shown in FIG. 4, each of the indicating members has the basic character of a tetrahedron, though modified in many details. The four points of the tetrahedron are at 10, 11, 12 and 13, with opposite points 12 and 13 having the form of short edges. As molded, member 9 is connected to skirt 7 at points 10, 11, and 12 by small integrally-molded bridges; it is also connected to its adjoining members, in ways to be later described. The lower edge 14 of the tetrahedron, between points 10 and 11, is elongated and curved to suit the number of indicating members and the overall size of the closure. Edges 15 and 16 do not connect to the main portion of the skirt, or are connected only by very thin webs. The areas of and about the bridges at points 10 and 11 may serve as tear zones during operation.

The bridges at points 10 and 11 serve not only as supports, but also as hinges, since they permit indicating member 9 to be tilted inward from its initial position, to one where point 12 is moved underneath shoulder 8, as shown at the left and right sides of FIG. 5, respectively. This movement will break the bridge at point 12 which serves as a temporary support.

Figure 3:
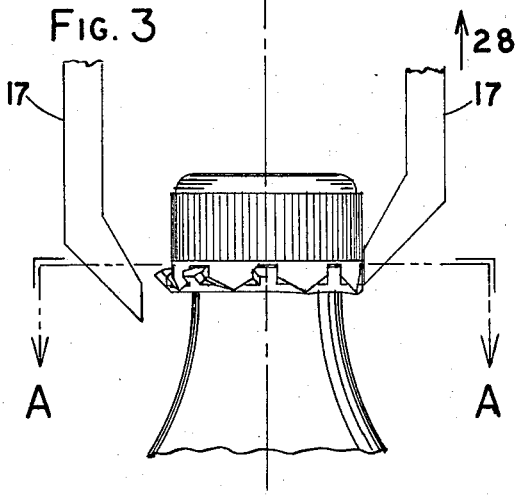
FIG. 3 is also a side view corresponding to FIG. 1, but in addition shows one type of installation tool used for pressing the indicating members into working position.

FIG. 3 shows how one form of installation tool may be used to tilt the set of indicating members inward after the closure has been screwed down to its final level. In this example, a suitably shaped tool 17 is moved downward to a point below and outside of indicating member 9. The tool is then moved inward and upward (shown by arrow 28) to press point 13 inwardly until it is approximately flush with the outer surface of skirt 7. Then point 12 will be properly positioned underneath shoulder 8.

In practice, a number of ironing tools such as 17 could be arranged to come together to form a complete ring around the set of indicating members, to set them all at the same time. Alternatively, tools of the same basic form could be equipped with rollers on the tips to reduce the amount of frictional drag on the indicating members, to avoid stressing bridges 10 and 11 unnecessarily. As another alternative, it is contemplated that a single, suitably-shaped ironing tool or roller tool may be caused to rotate one or more times about the central axes of the container and closure, in such a way as to close the series of indicating members sequentially rather than all at once. Regardless of which type of tool is used, the setting operation may be performed either as a part of the main closure application or at a subsequent station as a separate operation.

In order to hold the indicating members positively in their inward positions after once being placed there, retaining means are required. These are provided by a set of mating dovetail-like elements molded into the upper portion 18 of the indicating members and the adjacent areas of skirt 7. As best shown at the right side of FIG. 4, upper portion 18 has a cross-section in the form of a vertical hexagonal prism, the outer side faces 19 of which will mate with the corresponding angular faces 20 inside skirt 7, after the indicating member has been moved to its inward position. As shown at the left side of FIG. 4, the inner side faces 21 are angled in such a way as to provide wedging surfaces which momentarily deflect the resilient plastic lips of faces 20, to admit upper portion 18 of the indicating member, after which the lips resume their original shape.

In this condition, the closure installation is complete. When the closure is subsequently unscrewed by the user, shoulder 8 acts as a buttress to prevent member 9 from following, thereby placing substantial tension loads on the bridges at points 10 and 11. As will be discussed later, at least one of these bridges is weak enough to be fractured by the load so that it breaks away from skirt 7, and may also break away from the adjoining members 9.

It will be noted that each of the bridges is stressed by pressure from both of the indicating members adjoining it, also that each indicating member applies pressure to each of two different bridge areas of tear zones. These multiple interactions permit a wide variety of indicating patterns to be produced by selecting among the options shown in FIGS. 6A, B, C, and D which may be applied to any of the bridge areas such as those at points 10 and 11.

Figure 6A:
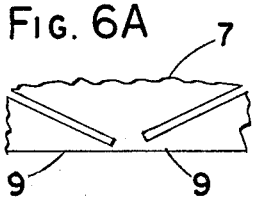
FIGS. 6A, 6B, 6C and 6D are enlarged details showing the four possible arrangements which may be used for the groups of bridges connecting the indicating members with the body of the closure, and with each other.

In FIG. 6A, the bridge connection between skirt 7 and member 9 on the right is relatively strong, so that any stress applied by member 9 will not be able to break it. On the other hand the connection between skirt 7 and member 9 on the left is weak enough that, while it will withstand the relatively small stress applied to it by the previous tilting action of the indicating member, it will break under direct pressure from unscrewing the closure.

Figure 6B:
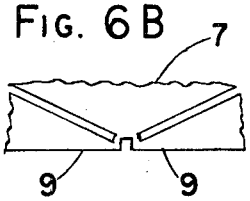

In FIG. 6B both members 9 have weak connections to skirt 7, so that they can both break away from it, and from each other.

In FIG. 6B, both members 9 are strongly connected to each other, but the pair is weakly connected to skirt 7, so that they will break away together.

Figure 6C:
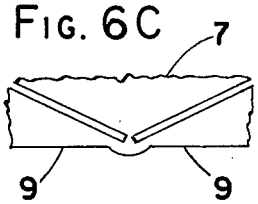
Figure 6D:
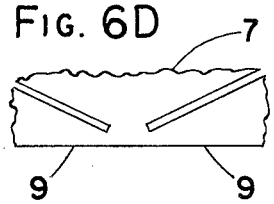

In FIG. 6D, all the connections are strong, so that neither of the members 9, can break away from the skirt.

As noted above, whenever one end of and indicating member is strongly connected to skirt 7, as in FIGS. 6A or 6D, the other end will have a breakable connection, to prevent stalling of the closure removal operation.

Figure 7A:
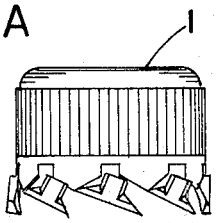
FIGS. 7A, 7B, and 7C show some representative tamper-indicating options which can be provided by use of the combinations shown in FIGS. 6A, 6B, 6C and 6D.

FIGS. 7A, B and C show some representative examples of the variety of indicating patterns which can be obtained by selective use of the combinations described in FIGS. 6A, B, C, and D.

FIGS. 7A shows the result of using the combination of FIG. 6A at all points on the circumference.

Figure 7B:
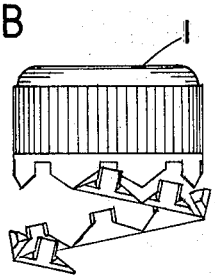

FIG. 7B shows the result of using the combination of FIG. 6A at one point on the circumference, and that of FIG. 6C at all the others.

Figure 7C:
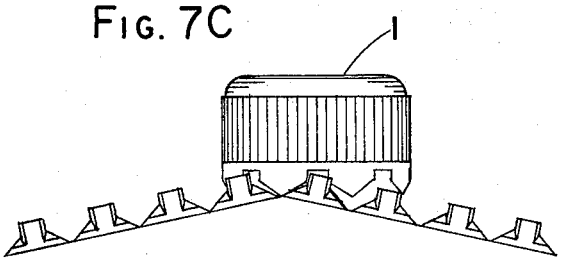

FIG. 7C shows the result of using the combination of FIG. 6D at one point on the circumference, FIG. 6B at the point directly opposite, and FIG. 6C at the remainder.

The right side of FIG. 5 shows in more detail the action of one of the indicating members as the closure is unscrewed. As the closure rises vertically in direction 22, the resistance of shoulder 8 results in a downward force on indicating member 9, in direction 24. More specifaally, the direction of the force is indicated by arrows and is determined by (a) the point of contact between member 9 and shoulder 8, and (b) the chord between the two hinge connections at either end of member 9. Since directions 22 and 24 are not directly opposed, there is a small resultant outward force component 25 at the hinge points, which is resisted by the skirt 7.

There may also be an outward force component 26 at point 12, if shoulder 9 is excessively conical, or if the radius at the outer edge of shoulder 8 is excessively large as a result of manufacturing tolerance variations. If such a wedging force should develop, it is resisted by the locking relationship between surfaces 19 and 20. This locking action continues until the closure has moved upward to the level where the locking surfaces slide apart, at which time the weak bridges will have broken.

It may be noted that, as shown up to this point, unscrewing of the closure should break all of the weak bridges at 10, 11 etc., simultaneously. However, simultaneous breaking is not necessary and may be undesirable since it concentrates the breaking loads at a single level during the unscrewing process. This condition may be prevented by varying the clearance between point 12 and shoulder 8, as controlled by the detailed design of the mold, so that pressure will be applied to one after another of the indicating members in succession as the closure is unscrewed. The same effect could also be acheived in another way by manufacturing the container with a slightly helical contour on shoulder 8, the helix having an angle different from that of main thread 3; such a helical contour could easily be incorporated into bottle molds, for example.

It may also be noted that the small recesses 27, which appear in FIGS. 2, 3 and 7, are not necessary to the function of the closure but are incorporated in order to simplify the mold construction.

In compliance with the requirements of the patent statutes I have herein shown and described a preferred embodiment of the invention. It is, however, to be understood that the invention is not limited to the particular construction shown, the same being merely illustrative of the principles of the invention and its scope is to be determined by that of the claims.

What is claimed is:

1. A tamper-indicating closure device for use with a threaded cylindrical outlet provided with a first shoulder, comprising a circular top surface and a cylindrical skirt depending therefrom, a device screw thread provided on said skirt for mating with the thread of said cylindrical outlet, at least one indicating portion on said device, an initial position of said indicating portion outside of the cylindrical surface of said skirt, a second position of said indicating portion inside of the cylindrical surface of said skirt, said indicating portion being movable radially of said skirt from said initial position to said second position, a tear zone of said device, a second shoulder on said indicating portion, whereby when said indicating portion is in the second position and when said second shoulder abuts said first shoulder, axial movement of said skirt with respect to said outlet causes said indicating portion to separate from the skirt at said tear zone.

2. A tamper-indicating closure device for use with a threaded cylindrical outlet provided with a shoulder, comprising a cylindrical skirt, an internal screw thread of said skirt for mating with said outlet, said cylindrical skirt having at least one dependent projection, at least one indicating portion, an initial position of said indicating portion outside of the cylindrical surface of said skirt, a second position of said indicating portion inside of the cylindrical surface of said skirt, connecting bridge means connecting each indicating portion to a respective dependent projection, a tear zone of each of said connecting bridge means, each indicating portion being movable between an initial position and a second position, whereby when said indicating portion is in the second position, and abutting said shoulder, axial movement of the skirt with respect to the outlet causes the connecting means to break away from said projection at said tear zone.

3. A closure device in accordance with claim 2 wherein each indicating portion applies stress to its corresponding connecting means during removal of said device from said outlet.

4. A closure device in accordance with claim 2 including a second connecting means for each indicating portion which does not break away from said dependent projection during removal of the device from the outlet.

5. A closure device in accordance with claim 2 including a second connecting means for each indicating portion which breaks away from said dependent projection during removal of the device from the outlet.

6. A closure device in accordance with claims 1 or 2 including a bridge attaching said indicating porion to said skirt acting as a temporary support which breaks when said indicating portion is moved between its initial position and its second position.

7. A closure device in accordance with claim 4 or 5 wherein each indicating portion applies stress to both first and second connecting means during removal of said device from said outlet.

8. A closure device in accordance with claims 1 or 2 which includes a means for maintaining said indicating portion in said second position prior to the axial movement of said device.

9. A tamper-indicating closure device for use with a threaded cylindrical outlet provided with a first shoulder, comprising a circular top surface and a cylindrical skirt depending therefrom, a device screw thread provided on said skirt for mating with the thread of said cylindrical outlet, at least one indicating portion on said device, said indicating portion being movable radially of said skirt from said initial position to said second position, a tear zone of said device, a second shoulder on said indicating portion, whereby when said indicating portion is in the second position and when said second shoulder abuts said first shoulder, axial movement of said skirt with respect to said outlet causes said indicating portion to separate from the skirt at said tear zone, means for maintaining said indicating portion in said second position including a resilient retaining lip molded as part of said skirt, and an inclined wedging surface on said indicating portion for deflecting said retaining lip during movement of said indicating portion from its first position to its second position, and an inclined locking surface on said indicating portion having a mating relationship with said retaining lip when said portion is in its second position.

10. A tamper-indicating closure device for use with a threaded cylindrical outlet provided with a first shoulder, comprising a circular top surface and a cylindrical skirt depending therefrom, a device screw thread provided on said skirt for mating with the thread of said cylindrical outlet, at least one indicating portion on said device, said indicating portion being movable radially of said skirt from said initial position to said second position, a tear zone of said device, a second shoulder on said indicating portion, whereby when said indicating portion is in the second position and when said second shoulder abuts said first shoulder, axial movement of said skirt with respect to said outlet causes said indicating portion to separate from the skirt at said tear zone, a plurality of indicating portions wherein the clearance between the shoulder of the outlet and each indicating portion, when said portions are in their second positions, is varied so as to proportionately vary the application of the axial force during removal of said device from the outlet.

11. A tamper-indicating closure device for use with a threaded cylindrical outlet provided with a shoulder, comprising a cylindrical skirt, an internal screw thread of said skirt for mating with said outlet, said cylindrical skirt having at least one dependent projection, at least one indicating portion, connecting bridge means connecting each indicating portion to a respective dependent projection, a tear zone of each of said connecting bridge means, each indicating portion being movable between an initial position and a second position, whereby when said indicating portion is in the second position, and abutting said shoulder, axial movement of the skirt with respect to the outlet causes the connecting means to break away from said projection at said tear zone means for maintaining said indicating portion in said second position includes a resilient retaining lip molded as part of said skirt, and an inclined wedging surface on said indicating portion for deflecting said retaining lip during movement of said indicating portion from its first position to its second position, and an inclined locking surface on said indicating portion having a mating relationship with said retaining lip when said portion is in its second position.

12. A tamper-indicating closure device for use with a threaded cylindrical outlet provided with a shoulder, comprising a cylindrical skirt, an internal screw thread of said skirt for mating with said outlet, and cylindrical skirt having at least one dependent projection, at least one indicating portion, connecting bridge means connecting each indicating portion to a respective dependent projection, a tear zone of each of said connecting bridge means, each indicating portion being movable between an initial position and a second position, whereby when said indicating portion is in the second position, and abutting said shoulder, axial movement of the skirt with respect to the outlet causes the connecting means to break away from said projection at said tear zone, a plurality of indicating portions wherein the clearance between the shoulder of the outlet and each indicating portion, when said portions are in their second positions, is varied so as to proportionately vary the application of the axial force during removal of said device from the outlet.

* * * * *